US010926937B1

(12) United States Patent
Olson et al.

(10) Patent No.: US 10,926,937 B1
(45) Date of Patent: Feb. 23, 2021

(54) LEAK-RESISTANT FOOD PACKAGE PRODUCTS AND METHODS THEREFOR

(71) Applicants: Paul A. Olson, Mora, MN (US); Donald W. Olson, Mora, MN (US); Eric Olson, Mora, MN (US)

(72) Inventors: Paul A. Olson, Mora, MN (US); Donald W. Olson, Mora, MN (US); Eric Olson, Mora, MN (US)

( * ) Notice: Subject to any disclaimer, the term of this patent is extended or adjusted under 35 U.S.C. 154(b) by 230 days.

(21) Appl. No.: 16/234,556

(22) Filed: Dec. 27, 2018

Related U.S. Application Data

(60) Provisional application No. 62/610,654, filed on Dec. 27, 2017.

(51) Int. Cl.

| | |
|---|---|
| ***B65B 29/08*** | (2006.01) |
| ***B65B 25/22*** | (2006.01) |
| ***B65B 51/02*** | (2006.01) |
| ***B65B 43/10*** | (2006.01) |
| ***B65D 65/14*** | (2006.01) |
| ***B31B 70/26*** | (2017.01) |
| ***B31B 70/62*** | (2017.01) |
| ***B65D 30/20*** | (2006.01) |
| ***B65D 81/34*** | (2006.01) |

(52) U.S. Cl.
CPC ..... *B65D 81/3469* (2013.01); *B31B 70/266* (2017.08); *B31B 70/62* (2017.08); *B65B 25/22* (2013.01); *B65B 29/08* (2013.01); *B65B 43/10* (2013.01); *B65B 51/02* (2013.01); *B65D 31/10* (2013.01); *B65D 65/14* (2013.01); *B65D 2581/344* (2013.01); *B65D 2581/3421* (2013.01); *B65D 2581/3445* (2013.01)

(58) Field of Classification Search
CPC ..... B65B 25/22; B65B 29/08; B65B 43/10; B65D 31/10; B65D 65/10; B65D 65/14; B65D 81/3469; B65D 2581/3421; B31B 70/62; B31B 70/266
USPC ..... 426/107; 219/727
See application file for complete search history.

(56) References Cited

U.S. PATENT DOCUMENTS

| | | | | |
|---|---|---|---|---|
| 2,149,872 | A * | 3/1939 | Schmidt | B65D 31/08 383/124 |
| 3,107,989 | A * | 10/1963 | Fesco | A47L 9/14 55/381 |
| 5,195,829 | A * | 3/1993 | Watkins et al. | B65D 81/3469 383/100 |
| 6,396,036 | B1 * | 5/2002 | Hanson | B65D 65/14 156/180 |
| 2005/0008736 | A1 * | 1/2005 | Egan et al. | B65D 81/3469 426/107 |
| 2005/0191399 | A1 * | 9/2005 | Jackson et al. | B65D 81/3469 426/621 |

(Continued)

FOREIGN PATENT DOCUMENTS

| | | | | |
|---|---|---|---|---|
| DE | 4431742 | A1 * | 3/1996 | B65D 31/10 |
| EP | 0294087 | A2 * | 12/1988 | B65D 81/3469 |

*Primary Examiner* — Stephen F. Gerrity
(74) *Attorney, Agent, or Firm* — Underwood & Associates, LLC

(57) ABSTRACT

A method for forming a food package product is disclosed. The food package product includes layers and patches of adhesive strategically placed on packaging stock that prevents leakage of liquid products. In an exemplary embodiment, the food package product is microwavable popcorn.

20 Claims, 6 Drawing Sheets

(56) References Cited

U.S. PATENT DOCUMENTS

| | | | | |
|---|---|---|---|---|
| 2008/0166457 | A1* | 7/2008 | Gorman et al. ... | B65D 81/3469 426/107 |
| 2012/0193350 | A1* | 8/2012 | Swingley et al. . | B65D 81/3469 219/727 |
| 2012/0213892 | A1* | 8/2012 | Jensen et al. ..... | B65D 81/3469 426/93 |
| 2015/0284168 | A1* | 10/2015 | Cohn ..... | B65B 29/08 426/113 |

* cited by examiner

LEAK-RESISTANT FOOD PACKAGE PRODUCTS AND METHODS THEREFOR

CROSS REFERENCE TO RELATED APPLICATIONS

This application claims priority to and the benefit under 35 USC § 119(e) of U.S. Provisional Patent Application No. 62/610,654, filed on Dec. 27, 2017, the contents of which are incorporated by reference in their entirety as if fully set forth herein.

TECHNICAL FIELD

This disclosure relates to methods for forming leak-resistant food package products. In particular, this disclosure relates to methods for making microwavable popcorn bags wherein adhesives and bag seals are strategically placed on stock packaging material in a bag-formation process to reduce the likelihood of liquid contents leaking therefrom.

BACKGROUND

Microwavable packaging for cooking or preparing foods such as popcorn are typically formed from a web of material into a pouch or bag to contain the product for shipping and sales. The web material may differ depending on the type of food being packaged. For example, vegetables packages, which may contain small amounts of added water for the production of steam, may be packaged in plastic pouches to prevent the water from leaking.

Microwavable popcorn packages are commonly formed from paper materials and can be coated with oil-resistant compounds to prevent wicking, weeping or leaking of liquid ingredients, which are typically oils. In addition, microwavable popcorn bags typically include a susceptor that provides an even heating platform for popping the corn kernels.

Commonly, the cooking oils selected for use in microwavable popcorn bags are ones that are solid at room temperature so that leaking is minimized, as long as the product is not exposed to heat above the melting point of the oil. Such cooking solids are typically very high in saturated or hydrogenated fats, both of which have been linked to the development of health problems. One reason for the use of 'solid' oils is that it reduces uptake of the oil into the bag; another reason is that microwavable popcorn bags are typically not entirely sealed due to the known methods used in the industry.

Some cooking oils having a low melting point—i.e., ones that are liquid at room temperature—have been found to impart a more desirable taste than the aforementioned 'solid' cooking oils and may also be a healthier alternative. However, to the best of Applicants' knowledge, the current state of the art in microwavable popcorn bag formation does not yield leak-proof packaging that can contain liquid oils during shipping, storage and presentation on consumer shelves. Accordingly, a microwavable popcorn bag possessing these qualities and offering a healthier food product is an unmet need in the food packaging industry.

SUMMARY

In general, a method for forming a microwavable popcorn bag from a web of bag material is presented. In one embodiment, such a method includes the strategic placement of seals and glues to form a microwavable popcorn bag that is substantially leak-proof and can contain liquid oils for at least the shelf life of the product.

In one exemplary aspect, a method for forming a food package product is provided. The method includes, for a substantially rectangular portion of packaging stock comprising top, bottom, left and right sides, a front surface and an opposite rear surface, and top left, top right, bottom left and bottom right corner portions, applying a top layer of adhesive to the front surface between the top left and top right corner portions, applying a bottom layer of adhesive to the front surface between the bottom left and bottom right corner portions, applying a layer of adhesive on the rear surface along and offset from the left side by an offset distance, applying a patch of adhesive to the bottom left corner of the rear surface, and bringing the bottom right corner of the front surface into sealing confrontation with the patch of adhesive.

In one embodiment, the adhesive is polyvinyl acetate.

In one embodiment, the top layer, the bottom layer and the patch of adhesive is polyvinyl acetate.

In an embodiment, the top layer of adhesive includes first ($1^{st}$) through eighth ($8^{th}$) adhesive extensions in series for forming gusset folds in the packaging stock. In one embodiment, the extensions are triangle-shaped. In one embodiment, the method further includes forming a first vertical, sigma (Σ)-shaped fold in the packaging stock between third and fourth adhesive extensions. In a related embodiment, the method further includes forming a second vertical, sigma (Σ)-shaped fold in the packaging stock between fifth and sixth adhesive extensions. In one embodiment, the method further includes creating a third vertical fold by bringing first and second adhesive extensions into a confronting relationship. In one embodiment, the method further includes creating a fourth vertical fold by bringing seventh and eight adhesive extensions into a confronting relationship. In one embodiment, the method further includes creating first and second horizontal folds in the packaging stock at approximately ⅓ and ⅔ vertical positions. In one embodiment, the method further includes applying a layer of adhesive to the front surface along at least of the first, second, third and fourth vertical folds. In one embodiment, the method further includes applying a layer of adhesive to the front surface along at least of the first, second, third and fourth vertical folds, and to at least one of the first and the second horizontal folds. In one embodiment, the method further includes applying adhesive to at least one area of the packaging stock where one of the horizontal and vertical folds intersect. In one embodiment, the method further includes applying adhesive to each vertical and horizontal fold intersection.

In one embodiment, the method further includes sealing the packaging stock along the top or the bottom edge. In one embodiment, the method further includes adding a food product to the packaging stock and sealing the food product within the packaging stock. In one embodiment, the food product is popcorn and a cooking oil. In one embodiment, the packaging stock is a portion of a microwavable popcorn web.

In one general aspect, a method for forming a leak-resistant microwavable popcorn bag includes providing a length of web material having top, bottom, left and right sides, and front and rear surfaces, applying an adhesive to the web material on the front surface adjacent and along the top side, applying an adhesive to the web material on the front surface adjacent and along the bottom side, applying an adhesive patch to the web material on the rear surface adjacent the intersection of the top and the left sides, and applying an adhesive patch to the web material on the rear surface adjacent the intersection of the bottom and the left sides.

In one general aspect, a method for forming a leak-resistant microwavable popcorn bag includes providing a length of web material having top, bottom, left and right sides, and front and rear surfaces, applying an adhesive to the web material on the front surface adjacent and along the top side, applying an adhesive to the web material on the front surface adjacent and along the bottom side, applying an adhesive patch to the web material on the rear surface adjacent the intersection of the top and the left sides, applying an adhesive patch to the web material on the rear surface adjacent the intersection of the bottom and the left sides, folding the web material to form a microwavable popcorn bag, the folding comprising forming gusset folds, and applying adhesive along at least one of the gusset folds.

Certain advantages of the systems and methods disclosed herein include a substantially leak-proof food package product capable of containing oils and other ingredients, wherein the substantially leak-proof food package product provides a cooking medium, e.g., unsaturated oil, for the popping of popcorn that may be healthier than industry standards; among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
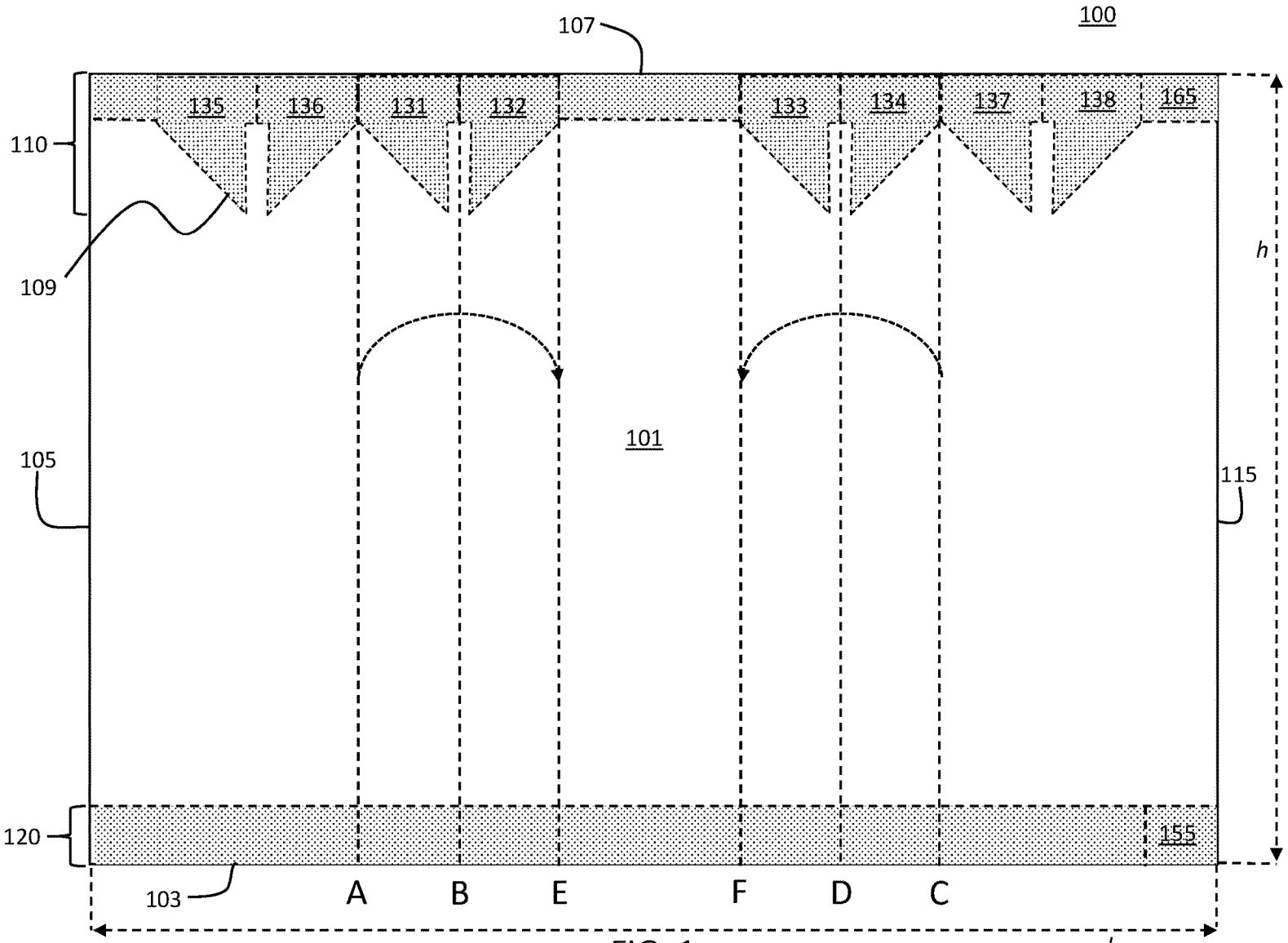
FIG. 1 is a web of microwavable popcorn packaging material illustrating portions where glues, seals and folds are applied to form a substantially leak-proof microwavable popcorn packing product according to one embodiment.

FIG. 1 shows a front surface 101 of a web of microwavable popcorn packaging material 100. As used herein, 'web' is a term known in the food product packaging industry that describes bulk packaging material, e.g., paper, plastic, etc., that individual packages, bags and other containers are made from. As is known in the industry, bulk web material can be fed into automated machinery that forms individual food product packages ('bags') from the web material. One such apparatus is described in U.S. patent application Ser. No. 14/675,629, filed Mar. 31, 2015 by Paul A. Olson et al., entitled "Systems and Methods for Automated Food Packaging." The "top" surface 101 of the web portion 100 as referenced refers to the interior portion of the food product package when formed, i.e., that portion of the package that contacts the consumable products within, and the "bottom" surface, which is opposite the top surface 101, becomes the exterior of the finished package.

Web 100 has a front surface 101 and an opposite rear surface and is of a shape and dimension of a typical single microwavable popcorn bag used for illustration in describing a method for forming a microwavable popcorn package product. In this non-limiting example, the left and right sides 105, 115, respectively have a height h between about nine (9) and about twelve (12) inches and the bottom and top sides 103, 107 have a length of about 19.5 inches. It should be understood that in FIGS. 1-4, bottom side 103 will ultimately be the top side of a microwavable popcorn bag; and front surface 101 will ultimately form the inner surface when the bag is formed, and product is finished and ready for consumer purchase. It should also be understood that the methods described herein can be applied to webs of any dimension and are not limited to popcorn bags.

Along the bottom side 103 there is applied a bottom layer of adhesive 120 between about 0.75 inch and about one (1) inch wide. Along the top side 107 there is applied a top layer of adhesive 110 between about 0.75 inch and about one (1) inch wide, which includes triangular protrusions for the purpose of forming gusset folds and is outlined for visual clarity of the drawing with dashed line 109. In this and other embodiments, any suitable adhesive can be used, however, in a preferred embodiment and for the purpose of this disclosure, the adhesive is polyvinyl acetate (PVA). The aforementioned top and bottom layers of adhesive 120, 110, respectively, can be applied, e.g., during a printing process of the bulk web material. Such printing of adhesive can be a first step in a method of forming a substantially leak-proof microwavable popcorn packaging product.

Figure 2:
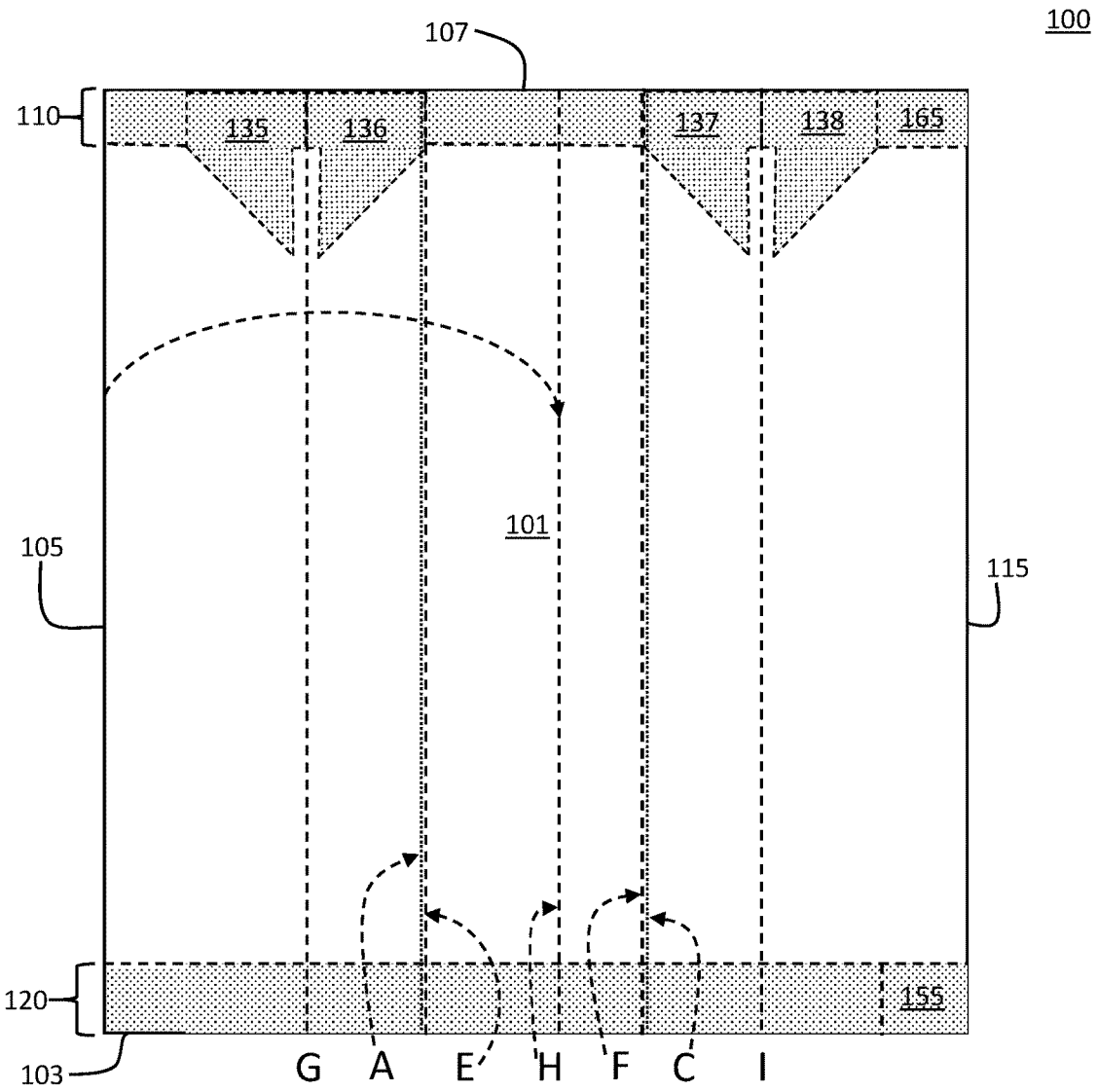
FIG. 2 is the web of FIG. 1, wherein folds have been applied thereto in a method for making a microwavable popcorn packaging product according to one embodiment.

Next, referring to FIGS. 1 and 2, sealed gusset folds can be formed. To form the sealed gusset folds, a sigma (Σ)-shaped fold is created by folding portion 100 along fold lines A and B, so that fold line A meets line E as illustrated by the curved arrow. Similarly, portion 100 is folded along lines C and D, so that fold line C meets line F as illustrated by the curved arrow. Such action brings areas 131/132 and 133/134, each having adhesive applied thereto, into confrontation for forming a seal therebetween. Depending on the type of adhesive used, the seal can be made, for example, by applying heat, pressure or a combination thereof. After these first folds have been made, the portion 100 appears as shown in FIG. 2. (Some reference numerals are omitted from FIG. 2 for clarity of the drawing.)

Next, web portion 100 can be folded along line G, such that left side 105 meets line H as illustrated by the curved arrow. Such action brings areas 135 and 136 into confrontation for forming a seal therebetween. After this fold has been made, a rear side portion 140 appears as shown in FIG. 3.

Figure 3:
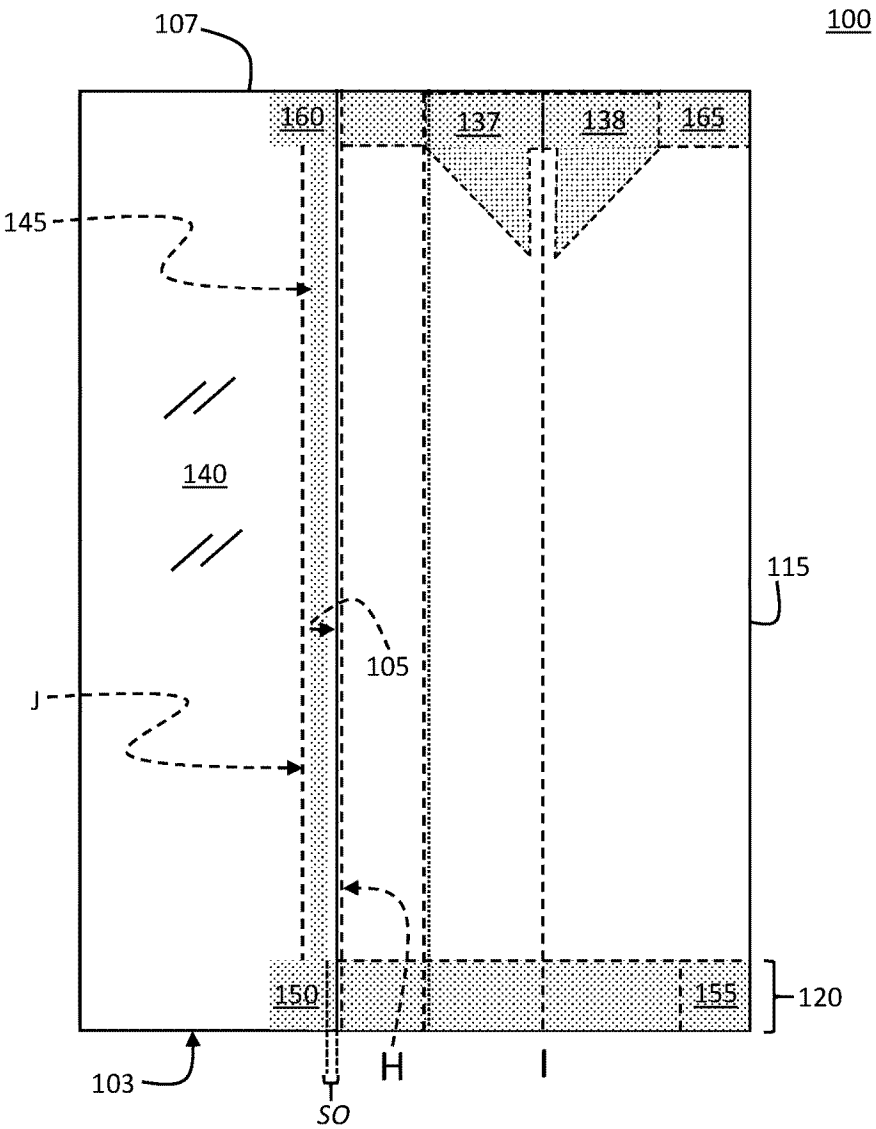
FIG. 3 is the web of FIG. 2, wherein further folds have been applied thereto in a method for making a microwavable popcorn packaging product according to one embodiment.

Referring to FIG. 3, left side 105 is folded over to meet line H (thereby exposing rear side portion 140 of the web portion 100 as shown). A vertical, outer adhesive layer 145 can be applied to the rear surface portion 140 as illustrated, to accommodate a lap seam seal as web portion 100 is folded at fold line I such that the right side 115 meets line J. Such action brings areas 137 and 138 into confrontation for forming a seal therebetween. However, as is known in the art, the outer adhesive layer 145 is commonly, if not always applied offset from the left edge 105 by a seam offset distance SO. This offset can create a channel of unglued bag portions that can allow leakage of liquid contents from the interior of the bag.

Figure 4:
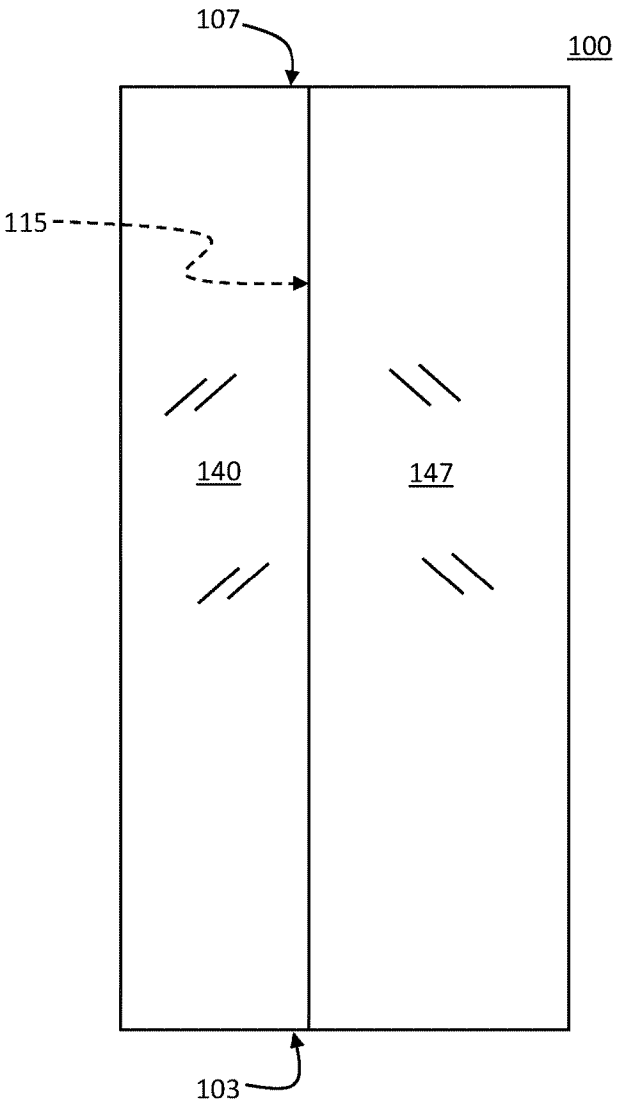
FIG. 4 is the web of FIG. 3, wherein further folds have been applied thereto in a method for making a microwavable popcorn packaging product according to one embodiment.

To prevent such occurrence, one or both of PVA patches 150 and 160 can be applied to the corners of the web portion 100 as illustrated. Thus, when fold I is created, PVA patch 150 confronts PVA portion 155; likewise, PVA patch 160 confronts PVA portion 165, thus sealing the corner portions of the bag and preventing the formation of channels that could lead to leakage of liquid ingredients. Without wishing to be bound by theory, it is suggested that surfaces each having PVA applied thereto will form greater seals (e.g., patch 150 to portion 155) than if only one surface includes PVA. When fold I is created (thereby exposing rear portion 147 of web portion 100 as shown), right side 115 confronts adhesive layer 145 which forms a lap seam and completes formation of the microwavable popcorn packaged product (FIG. 4).

Figure 5:
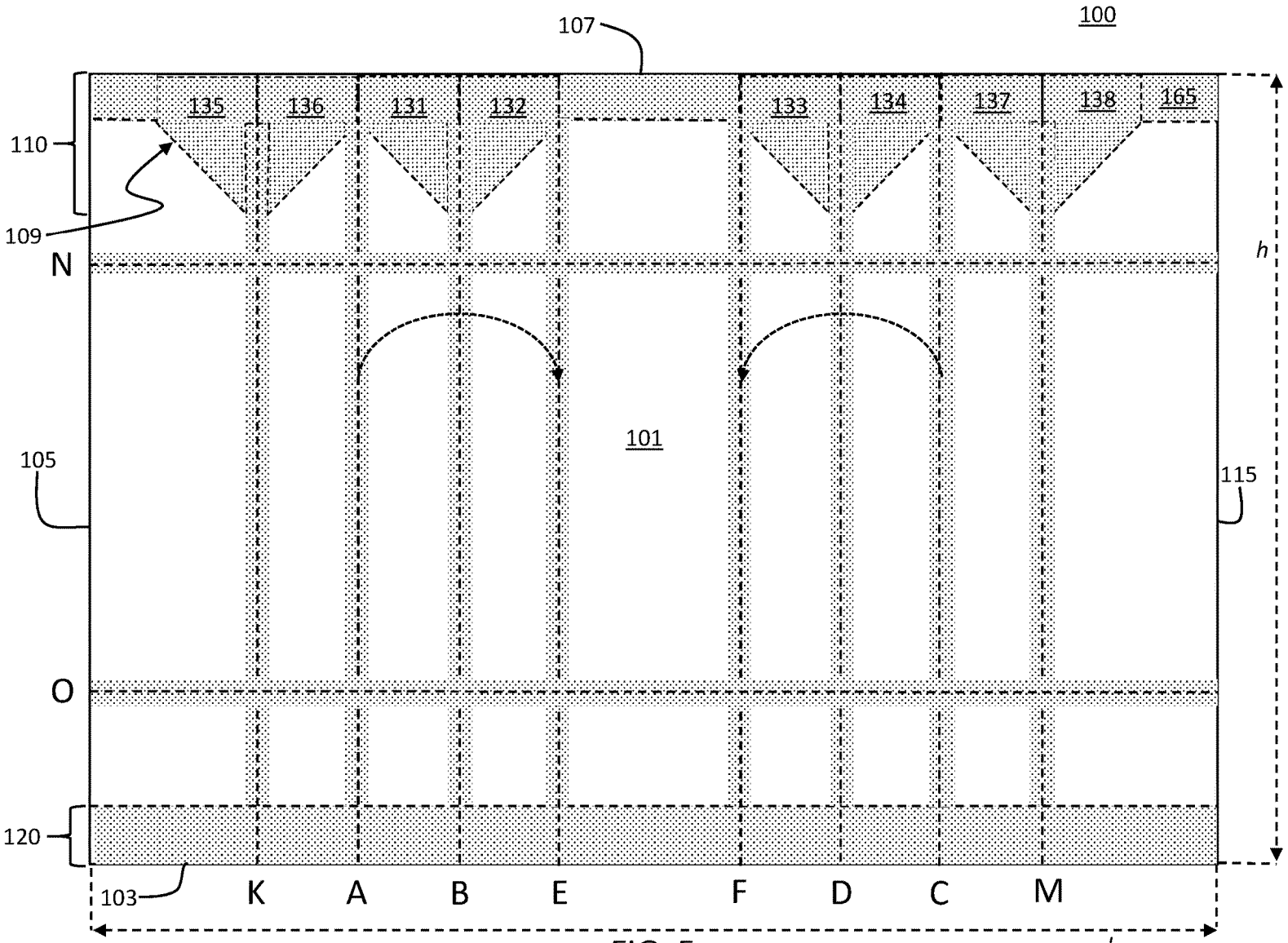
FIG. 5 is the web of FIG. 1 illustrating the use of adhesives placed along fold lines, according to one embodiment.

Referring now to FIG. 5, it is generally known that web material 100 itself is substantially impermeable to oils, e.g., by including a lipophobic layer. However, without wishing to be bound by theory, it is believed that the process of folding web material 100 introduces a breakdown or disintegration of the lipophobic properties of the material which can allow weeping of bag ingredients, e.g., oils, over time. To address this issue, in one alternative embodiment, adhesive strips can be applied to areas of the web material 100 where folds are placed.

For example, FIG. 5 illustrates the application of PVA, illustrated by the shaded strips, along vertical folds K, A, B, E, F, D, C and M; likewise, PVA is applied to horizontal folds N and O as illustrated. It should be understood that adhesive such as PVA can be applied to any combination of the aforementioned folds to best prevent or reduce the likelihood of leakage of liquid contents from the bag. Similarly, adhesive such as PVA can be advantageously applied to front (101) or rear surfaces of the web material 100 to provide optimal sealing.

Figure 6:
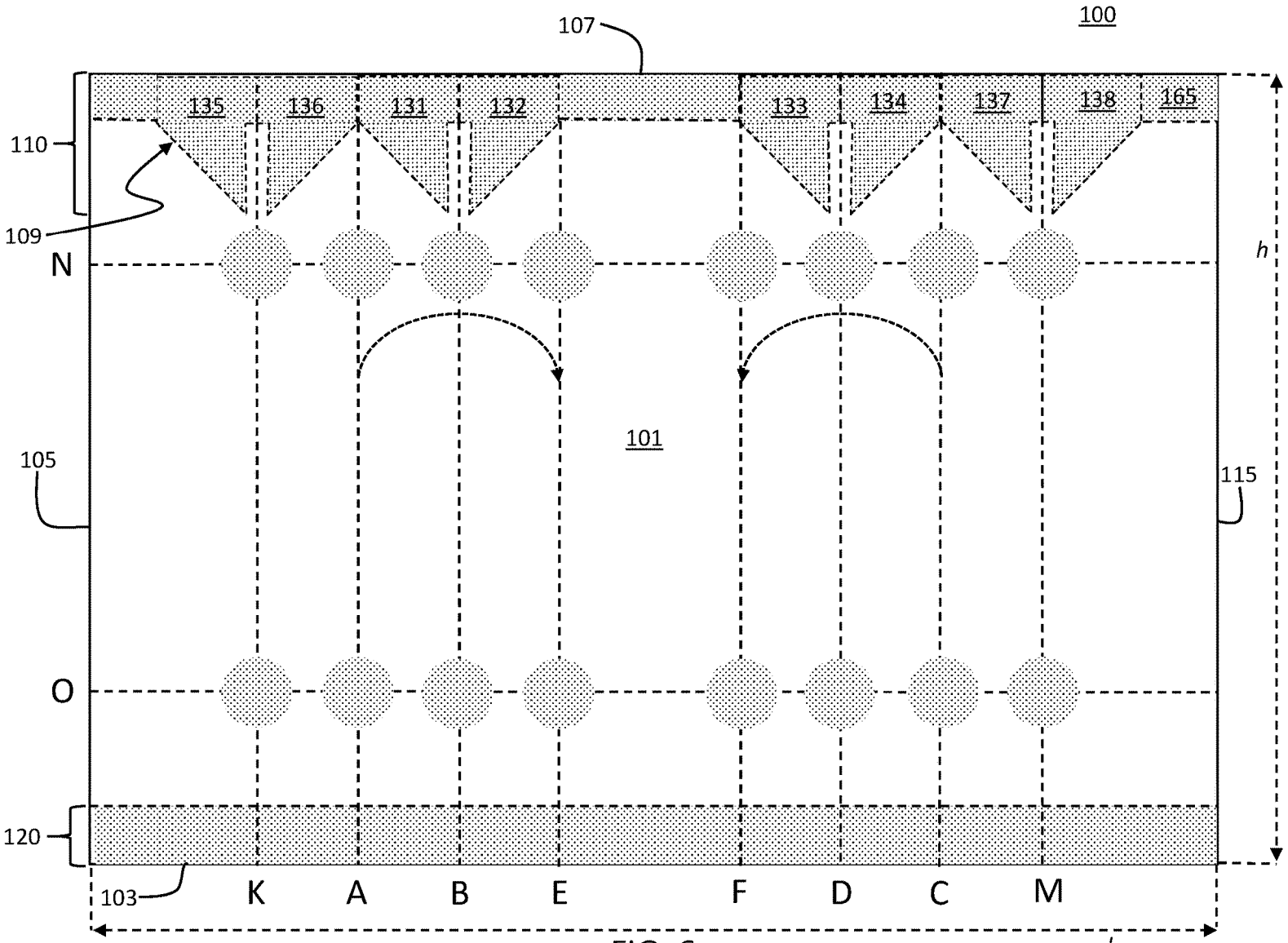
FIG. 6 is the web of FIG. 1 illustrating the use of adhesives placed at the intersection of fold lines, according to one embodiment.

Referring now to FIG. 6, in an alternative approach, adhesive such as PVA can be applied to the areas where folds intersect, such as the intersection of folds N and K, O and K, etc., as illustrated. In such an approach, the adhesive can be applied as a circular patch as illustrated, or in any other desired geometric pattern. Again, without wishing to be bound by theory, it is suggested that the areas of web material 100 that are most likely to be susceptible to breakdown are where folds intersect. Therefore, the approach as illustrated in FIG. 6 may reduce the amount of adhesive necessary to form a leak-proof or leak-resistant bag. In this case as with other embodiments, adhesive can be placed on front, rear, or a combination of front and rear sides of web material 100 as necessary or desired.

In general, it should be understood that the steps of forming a microwavable popcorn package product can be varied from that disclosed herein. For example, depending on the ingredients of a microwavable popcorn product, the various seals described may be formed out of sequence from that described herein. Furthermore, a first set of seals may be accomplished, e.g., along one or more of the top, bottom or side of the bag, followed by addition of ingredients, followed by formation of additional seals to form a package product. In general, seals can be formed through the application of heat, pressure, moisture or any combination thereof, or by other methods which may be dependent upon the type and composition of adhesives used in the process. In general, PVA and other adhesives can be applied or 'printed' to the web portion 100 according to preference. Because the disclosed method includes applying PVA to inner and outer surfaces of the web material, any suitable method can be used to prevent the web from sticking to itself in its bulk storage state or form, e.g., when it is rolled. For example, a layer of wax film can be concurrently rolled with the web material such that the wax film is interposed between layers of the web. In another example, a heat- or pressure-soluble or degradable film can be applied to cover PVA patches 150 and 160.

A number of illustrative embodiments have been described. Nevertheless, it will be understood that various modifications may be made without departing from the spirit and scope of the various embodiments presented herein. For example, while microwavable popcorn is a packaged product suitable for this disclosure, the method and steps disclosed herein can be applied to other packaged products, including, without limitation, microwavable vegetables, rice, noodles, dinners and other foods. Accordingly, other embodiments are within the scope of the following claims.

What is claimed is:

1. A method for forming a food package product, comprising:

for a substantially rectangular portion of packaging stock comprising top, bottom, left and right sides, a front surface and an opposite rear surface, and top left, top right, bottom left and bottom right corner portions:

applying a top layer of adhesive to said front surface between said top left and top right corner portions;

applying a bottom layer of adhesive to said front surface between said bottom left and bottom right corner portions;

applying a layer of adhesive on said rear surface along and offset from said left side by an offset distance;

applying a patch of adhesive to said bottom left corner of said rear surface; and bringing said bottom right corner of said front surface into sealing confrontation with said patch of adhesive.

2. The method of claim 1, wherein said adhesive is polyvinyl acetate.

3. The method of claim 1, wherein each of said top layer, said bottom layer and said patch of adhesive is polyvinyl acetate.

4. The method of claim 1, wherein said top layer of adhesive comprises first ($1^{st}$) through eighth ($8^{th}$) adhesive layer protrusions for forming gusset folds in said packaging stock.

5. The method of claim 4, wherein said adhesive layer protrusions are triangle-shaped.

6. The method of claim 5, further comprising forming a first vertical, sigma (Σ)-shaped fold in said packaging stock between the third and fourth adhesive layer protrusions.

7. The method of claim 6, further comprising forming a second vertical, sigma (Σ)-shaped fold in said packaging stock between the fifth and sixth adhesive layer protrusions.

8. The method of claim 7, further comprising creating a third vertical fold by bringing the first and second adhesive layer protrusions into a confronting relationship.

9. The method of claim 8, further comprising creating a fourth vertical fold by bringing the seventh and eight adhesive layer protrusions into a confronting relationship.

10. The method of claim 9, further comprising applying a layer of adhesive to said front surface along at least one of said first, second, third and fourth vertical folds.

11. The method of claim 9, further comprising creating first and second horizontal folds in said packaging stock at approximately one-third and two-thirds of the height of the packaging stock, respectively.

12. The method of claim 11, further comprising applying a layer of adhesive to said front surface along at least one of said first, second, third and fourth vertical folds, and to at least one of said first and said second horizontal folds.

13. The method of claim 11, further comprising applying adhesive to at least one area of said packaging stock where one of said horizontal and vertical folds intersect.

14. The method of claim 11, further comprising applying adhesive to each vertical and horizontal fold intersection.

15. The method of claim 1, further comprising sealing said packaging stock along said top or said bottom edge.

16. The method of claim 15, further comprising adding a food product to the packaging stock and sealing said food product within said packaging stock.

17. The method of claim 15, wherein said food product is popcorn and a cooking oil.

18. The method of claim 1, wherein said packaging stock is a portion of a microwavable popcorn web.

19. A method for forming a leak-resistant microwavable popcorn bag, comprising:

providing a length of web material having top, bottom, left and right sides, and front and rear surfaces;

applying an adhesive to said web material on said front surface adjacent and along said top side;

applying an adhesive to said web material on said front surface adjacent and along said bottom side;

applying an adhesive patch to said web material on said rear surface adjacent the intersection of said top and said left sides; and applying an adhesive patch to said web material on said rear surface adjacent the intersection of said bottom and said left sides.

20. A method for forming a leak-resistant microwavable popcorn bag, comprising:

providing a length of web material having top, bottom, left and right sides, and front and rear surfaces;

applying an adhesive to said web material on said front surface adjacent and along said top side;

applying an adhesive to said web material on said front surface adjacent and along said bottom side;

applying an adhesive patch to said web material on said rear surface adjacent the intersection of said top and said left sides;

applying an adhesive patch to said web material on said rear surface adjacent the intersection of said bottom and said left sides;

folding said web material to form a microwavable popcorn bag, said folding comprising forming gusset folds; and applying adhesive along at least one of said gusset folds.

* * * * *